United States Patent [19]

Rymut

[11] Patent Number: 5,043,701

[45] Date of Patent: Aug. 27, 1991

[54] MULTI-INPUT ELECTRICAL MONITOR

[75] Inventor: Michael J. Rymut, Cadillac, Mich.

[73] Assignee: Nartron Corporation, Reed City, Mich.

[21] Appl. No.: 526,105

[22] Filed: May 21, 1990

[51] Int. Cl.[5] ..... G08B 23/00

[52] U.S. Cl. ..... 340/517; 340/506; 340/513; 340/521

[58] Field of Search ..... 340/517, 521, 520, 522, 340/506, 508, 513

[56] References Cited

U.S. PATENT DOCUMENTS 3,289,193 11/1966 Worthington et al. ..... 340/517
3,950,745 4/1976 Miller .
3,978,478 8/1976 Schmitz ..... 340/506
4,204,201 5/1980 Williams et al. ..... 340/517
4,536,747 8/1985 Jensen ..... 340/521

*Primary Examiner*—Donnie L. Crosland
*Attorney, Agent, or Firm*—Lon H. Romanski

[57] ABSTRACT

A multi-input electrical monitor has a plurality of input terminals for connection to a plurality of condition responsive transducers whereby some of the input terminals receive electrically high signals while other of the input terminals receive electrically low signals when the transducers respond to abnormal conditons; a signal generator responds to the existance of such abnormal conditions even though the input signals indicative thereof can be either electrically high or low.

30 Claims, 3 Drawing Sheets

MULTI-INPUT ELECTRICAL MONITOR

FIELD OF THE INVENTION

This invention relates generally to electrical circuit monitoring means and more particularly to such monitoring means wherein multiple parameters are to be monitored.

BACKGROUND OF THE INVENTION

Heretofore, especially in automobile and truck applications, it had become desirable to sense various operating parameters as well as other vehicular conditions reflective of, for example, vehicle and/or passenger safety.

In an attempt to satisfy such attendant sensing requirements, the prior art has, heretofore, provided a plurality of sensing devices for respectively sensing a plurality of operating parameters and then supplied a like plurality of warning devices respectively actuatable directly in response to the operation of respective ones of said plurality of sensing devices. This prior art approach has proven to be extremely costly and not totally reliable. Usually, such prior art systems are tailored as to have, for example, a particular sensor and cooperating warning device employable for only one particular application and, therefore, this, in turn, requires the greatly added expense of providing different tooling and testing equipment for the manufacturing of each such sensor and warning device combination as well as the added expense of installing each such combination within the vehicle. Further, in those situations wherein the prior art has attempted to provide a single electrical monitoring assembly having multiple inputs, such were not effectively capable of operatively receiving both electrically LOW and electrically HIGH input signals either one of which might be employed to indicate an abnormal condition of a particular parameter.

Accordingly, the invention as herein disclosed and described is primarily concerned with the solution of foregoing as well as other related and attendant problems of the prior art.

SUMMARY OF THE INVENTION

According to the invention, a multi-input electrical monitor comprises a plurality of input terminal means effective for connection to a plurality of associated condition sensing means, second terminal means for connection to an associated source of electrical potential, wherein at least a certain of said plurality of input terminal means receives a first input signal from a certain of said associated condition sensing means, wherein said first input signal is either electrically HIGH or electrically LOW depending upon the condition sensed by said certain of said associated condition sensing means, wherein said first input signal is electrically HIGH when the condition sensed by said certain of said associated condition sensing means is normal, wherein said first input signal is electrically LOW when the condition sensed by said certain of said associated condition sensing means is abnormal, wherein at least an other of said plurality of input terminal means receives a second input signal from an other of said associated condition sensing means, wherein said second input signal is either electrically HIGH or electrically LOW depending upon the condition sensed by said other of said associated condition sensing means, wherein said second input signal is electrically LOW when the condition sensed by said other of said associated condition sensing means is normal, wherein said second input signal is electrically HIGH when the condition sensed by said other of said associated condition sensing means is abnormal, output signal generating means electrically connected to said second terminal means, and electrical logic circuitry means electrically interconnecting said certain of said plurality of input terminal means and said other of said plurality of input terminal means to said output signal generating means whereby said output signal generating means is caused to produce an output signal whenever said first input signal is electrically LOW or whenever said second input signal is electrically HIGH.

Various objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENTS

Figure 1:
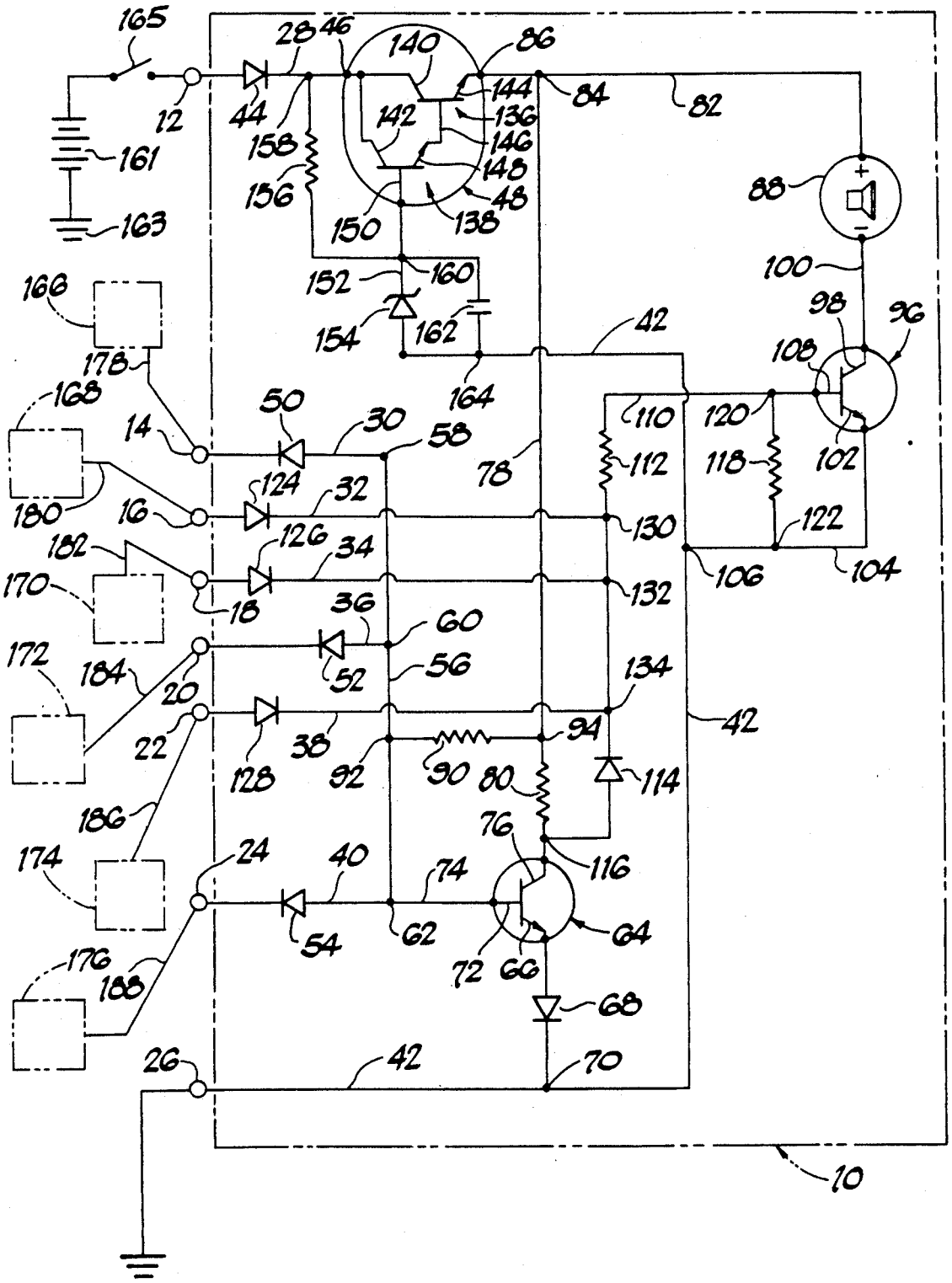
FIG. 1 is a schematic wiring diagram illustrating a multi-input electrical monitor employing teachings of the invention.

Referring now in greater detail to the drawings, in FIG. 1, the electrical warning means and system 10 is illustrated as comprising a plurality o terminal or contact means 12, 14, 16, 18, 20, 22, 24 and 26 which, in turn, are depicted as being respectively connected to conductor means 28, 30, 32, 34, 36, 38, 40 and 42.

Conductor means 28, comprising a diode 44, is connected to the collector terminal 46 of a Darlington transistor 48 while conductor means 30, 36 and 40, respectively comprising diodes 50, 52 and 54, are each electrically connected to a common conductor means 56 as at respective points 58, 60 and 62.

An NPN transistor 64 has its emitter 66 electrically connected, through diode means 68, to conductor means 42 as at point 70. The base 72 of transistor 64 is connected, as by conductor means 74, to conductor means 56 as at point 62. The collector 76 of transistor 64 is connected through conductor means 78 and series resistor means 80 to a conductor 82, as at a point 84 thereof, which is connected to the emitter terminal 86 of Darlington transistor 48. The other electrical end of conductor means 82 is connected to one electrical side of suitable output signal generating means 88. A resistance means 90 has its opposite ends electrically connected to conductor means 56 and 78, as at points 92 and 94, with such point 94 being, generally, electrically between the resistor 80 and emitter 86.

An NPN transistor 96 has its collector 98 electrically connected, as via conductor means 100, to the other electrical side of signal generating means 88 while its emitter 102 is electrically connected, as via conductor means 104, to conductor means 42 as at a point 106 thereof. The base 108 of transistor 96 is connected as by conductor means 110, comprising series situated resistor means 112 and diode means 114, to conductor means 78 as at a point 116 generally electrically between resistor means 80 and collector 76 of transistor 64. A resistance means 118 has its opposite ends electrically connected to conductor means 110 and 104, as at points 120 and 122 thereof, wherein such point 120 is electrically between base 108 and resistor 112 while point 122 is electrically between emitter 102 and ground terminal 26.

Conductor means 32, 34 and 38 respectively comprising diodes 124, 126 and 128, are each electrically connected to conductor means 110 as at respective points 130, 132, and 134 each of which is generally electrically between diode 114 and resistance means 112.

As is generally well known, the Darlington transistor or circuit 48 is comprised of transistors 136 and 138 with their respective collectors 140 and 142 electrically connected to the collector terminal 46 and the emitter 144 of transistor 136 being electrically connected to the emitter terminal 86. The base 146 of transistor 136 is electrically connected to the emitter 148 of transistor 138 while the base 150 of transistor 138 is electrically connected, as via conductor means 152, to one electrical side of a zener diode 154 which has its other electrical side connected to conductor means 42.

A resistor 156 has its opposite electrical ends connected to conductor means 28, as at a point 158 generally electrically between diode 44 and collector terminal 46, and to conductor means 152 as at a point 160 generally electrically between base 150 and zener diode 154. Capacitor means 162 is also situated as to have one electrical side thereof connected to conductor means 152, as at point 60, and as to have its other electrical side connected to conductor means 42 as at a point 164 thereof.

A suitable source of electrical potential 161, grounded as at 163, is electrically connected, through switch means 165, to contact or terminal means 12.

In the embodiment of FIG. 1, the various components may have values and/or be identified as to their types and sources as follows:

| | | | |
|---|---|---|---|
| Resistor | 156: | 10K | |
| Resistor | 90: | 15K | |
| Resistor | 80: | 4.7K | |
| Resistor | 112: | 2.0K | |
| Resistor | 118: | 20K | |
| Capacitor | 162: | 0.01 $\mu f$ | 50.0 V. |

Each of the diodes 44, 50, 124, 126, 52, 128, 54, 68 and 114 could be type IN4004: zener diode 154 could be type IN5245; Darlington transistor 48 could be type MPSA13 obtainable from Motorola Semiconductor Products, Inc. of Phoenix, Ariz.; transistors 64 and 96 could each be type 2N4124 obtainable from said Motorola Semiconductor Products, Inc.; and the sensory signal generating means 88 may be an audio transducer commercially available, as item or model TMB-12, from OEM Division, of Star Micronics Corp., of 70-D Ethel Road West, Piscataway, N.J.

In FIG. 1, various indicia or condition sensing and responsive devices or transducers are depicted as at 166, 168, 170, 172, 174 and 176 and such are further depicted as being respectively electrically connected to terminal or contact means 14, 16, 18, 20, 22 and 24 via conductor means 178, 180, 182, 184, 186 and 188. If the assembly and system 10 were employed in combination with, for example, an automotive vehicle as an automobile, truck, bus or the like, such transducer means 166–176 could be responsive to such conditions as, for example: (a) engine oil pressure; (b) engine coolant temperature; (c) radiator coolant level; (d) battery line charge voltage from (generator) alternator; (e) battery voltage; (f) transmission overdrive lock-out; (g) vehicular parking brake failure; and, especially with regard to buses and/or trucks (h) air pressure in air tanks; (i) correctness of air line attachment from the tractor to its trailer; correctness of attachment of electrical harness from the tractor to its trailer; and (k) oil pump pressure. It should be clear that the invention is not so limited and may be employed in many other environments and applications among which would be industrial applications wherein transducer means would be employed for responding to the presence or absence of operating parameters or even in the modification or change in operating parameters. Also, the invention 10 may be employed in combination with other operating electrical circuitry with the inputs at 14, 16, 18, 20, 22 and 24 being referenced to selected points of such operating electrical circuitry as to respond to such monitored selected points.

OPERATION OF THE INVENTION

For purposes of description, let it be assumed that the invention as disclosed in FIG. 1 is employed in combination with a (tractor-trailer) truck and that the source of electrical potential 161 could be: (1) the truck battery; or (2) the truck (generator) alternator; or (3) even the truck battery and alternator combined in their function as being a source of electrical potential, and that the transducers 166, 168, 170, 172, 174 and 176 are operatively carried by the truck as to be responsive to selected operating conditions and/or parameters. Also, for purposes of description, let it be assumed that switch 165 comprises the vehicular engine ignition switch assembly which, in turn, as is well known, may also complete electrical circuits to various engine and/or vehicular accessories.

In the embodiment of FIG. 1, and for purposes of description, let it be further assumed:

(A) Transducer means 166 is responsive to engine temperature and in response thereto produces a volta signal as along conductor 178 and applies such voltage signal to input terminal means 14. Further, let it be assumed that such voltage signal may range from 0.0 volts to 15.0 volts and that a signal in the range of 0.0 volts to 0.6 volts, which may be considered functionally equivalent to electrical ground, (hereinafter referred to as LOW) is intended to indicate that the temperature of the engine has attained a magnitude deemed to be excessive while such a voltage signal in the range of greater than 0.6 volts to 15.0 volts (hereinafter referred to as HIGH) is intended to indicate that the temperature of the engine is in a safe, normal or desired range.

(B) Transducer means 168 is responsive to engine oil pressure and in response thereto produces a voltage signal as along conductor 180 and applies such voltage signal to input terminal means 16. Further, let it be assumed that such voltage signal may range from 0.0 volts to 15.0 volts and that a signal in the range of 1.2 volts to 15.0 volts (hereinafter referred to as HIGH) is intended to indicate that the engine oil pressure has decreased to a magnitude deemed to be insufficient (at least approaching an unsafe condition for engine operation) while such a voltage signal in the range of 0.0 volts to less than 1.2 volts, which may be considered functionally equivalent to electrical ground, (hereinafter referred to as LOW) is intended to indicate that the magnitude of the engine oil pressure is in a safe, normal or desired range.

(C) Transducer means 170 is responsive to engine radiator coolant supply, or level, and in response thereto produces a voltage signal as along conductor 182 and applies such voltage signal to input terminal means 18. Further, let it be assumed that such voltage signal may range from 0.0 volts to 15.0 volts and that a signal in the range of 1.2 volts to 15.0 volts (hereinafter referred to as HIGH) is intended to indicate that the coolant supply in the radiator has decreased to a magnitude deemed to be insufficient (or at least approaching an unsafe condition for engine operation) while such a voltage signal in the range of 0.0 volts to less than 1.2 volts, which may be considered functionally equivalent to electrical ground, (hereinafter referred to as LOW) is intended to indicate that the magnitude of the engine coolant supply in the radiator is in a safe, normal or desired range.

(D) Transducer means 172 is responsive to the magnitude of the vehicular battery voltage and in response thereto produces a voltage signal as along conductor 184 and applies such voltage signal to input terminal means 20. Further, let it be assumed that such voltage signal may range from 0.0 volts to 15.0 volts and that a signal in the range of 0.0 volts to 0.6 volts, which may be considered functionally equivalent to electrical ground, (hereinafter referred to as LOW) is intended to indicate that the magnitude of the monitored battery voltage has diminished to where it is deemed insufficient while such a voltage signal in the range of greater than 0.6 volts to 15.0 volts (hereinafter referred to as HIGH) is intended to indicate that the magnitude of the monitored battery voltage is in a safe, normal or desired range.

(E) Transducer means 174 is responsive to engine speed and in response thereto produces a voltage signal as along conductor 186 and applies such voltage signal to input voltage signal may range from 0.0 volts to 15.0 volts and that a signal in the range of 1.2 volts to 15.0 volts (hereinafter referred to as HIGH) is intended to indicate that the monitored engine speed has increased to a magnitude deemed to be excessive (or at least approaching an engine speed which is considered excessive) while such a voltage signal in the range of 0.0 volts to less than 1.2 volts, which may be considered functionally equivalent to electrical ground, (hereinafter referred to as LOW) is intended to indicate that the magnitude of engine speed is in a safe, normal or desired range.

(F) Transducer means 176 is responsive to the magnitude of the engine oil supply and in response thereto produces a signal as along conductor 188 and applies such volt signal to input terminal means 24. Further, let it be assumed that such voltage signal may range from 0.0 volts to 15.0 volts and that a signal in the range of 0.0 volts to 0.6 volts, which may be considered functionally equivalent to electrical ground, (hereinafter referred to as LOW) is intended to indicate that the magnitude of the monitored quantity of engine oil has diminished to where it is deemed to be insufficient (or at least approaching a quantity which is considered to be insufficient) while such a voltage signal in the range of greater than 0.6 volts to 15.0 volts (hereinafter referred to as HIGH) is intended to indicate that the magnitude of the monitored quantity of engine oil is in a safe, normal or desired range.

In view of the foregoing, it can be summarized that when the various monitored indicia or parameters are normal (or in their respective normal ranges), the output signals: (a) from transducers 166, 172 and 176 will each be HIGH and (b) from transducers 168, 170 and 174 will each be LOW. Further, when the various monitored indicia or parameters are beyond their respective normal ranges, the output signals: (i) from transducers 166, 172 and 176 will each be LOW and (ii) from transducers 168, 170 and 174 will each be HIGH.

Let it now be assumed that the switch 165 has been closed and that the vehicular engine is operating.

Diode 44 is provided in order to block current flow in the event that the power inputs to the system 10 are accidentally reversed.

The Darlington transistor 48, in conjunction with zener diode 154, functions as a series voltage regulator. voltage supplied by the source 161, in the assumed automotive vehicle, may be in the order of 13.5 volts and since zener diode 154 is a 15.0 volt diode, current will not usually flow in zener diode 154. However, current will flow through resistance 156 and into base 150 of transistor 48 and such current flow through base 150 will turn transistor 48 "on".

If the ignition or supply voltage were to exceed 15.0 volts, then zener diode 154 would divert current from base 150 to ground, as via conductor means 42, so that the base voltage relative to ground could never exceed 15.0 volts.

Such an increase in ignition or supply voltage could occur if, for example, one were to place a 24.0 volt battery in referred to as "jumping"), or if a load dump occurred; i.e., the vehicular battery became disconnected while under load causing the generator to produce a high voltage pulse of significant duration.

Capacitor 162 serves as a filter for voltage spikes as may appear at base 150.

During normal conditions, the input signals from respective transducers 166, 172 and 176 to input terminal means 14, 20 and 24 are each HIGH. It is, of course, desired that when any or all of such input signals become LOW that the sensory alarm means 88 become energized.

When the input signals on terminal means 14, 20 and 24 are each HIGH, diodes 50, 52 and 54 block current flow to base 108 of transistor 96 through diodes 50, 52, 54 and 114. However, resistance 90 is electrically connected from the emitter 144 of transistor 48, as at point 84, to the base 72 transistor 64 causing transistor 64 to be turned "on". This, in turn, means that the collector 76 of transistor 64 is at a low voltage with respect to ground and therefore does not supply a voltage capable of turning transistor 96 "on", through resistance means 112. Consequently, when the input signals on input terminal means are each normal, HIGH, the alarm means 88 is not energized.

During normal conditions, the input signals from respective transducers 168, 170 and 174 to input terminal means 16, 18 and 22 are each LOW, functionally equivalent to electrical ground, and therefore either no or insufficient current will flow through resistance 112 to base 108 of transistor 96 and transistor 96 will remain nonconductive, "off". Consequently, during such normal conditions the alarm means 88 will remain de-energized.

However, when the input signal on input terminal means 16 becomes HIGH current will flow from input terminal means 16 through diode 124 via conductor means 32 to point 130 of conductor means 110, through resistance means 112 and into base 108 of transistor 96 causing transistor 96 to turn "on". The current at point 130 cannot flow to point 116 because of diode 114. As transistor 96 thusly becomes conductive through its collector 98 emitter 102 circuit, the circuit through sensory signal generating means 88 is completed and the means 88, thusly being energized, produces an audible alarm.

Similarly, when the input signal on terminal means 18, from transducer means 170, becomes HIGH current will flow from input terminal means 18 through diode 126 via conductor means 34 to point 132 of conductor means 110, through resistance means 112 and into base 108 of transistor 96 causing transistor 96 to turn "on". The current at point 132 cannot flow to point 116 because of diode 114. As transistor 96 thusly becomes conductive through its collector 98 emitter 102 circuit, the circuit through sensory signal generating means 88 is completed and the means 88, thusly being energized, produces an audible alarm.

Likewise, when the input signal on terminal means 22, from transducer means 174, becomes HIGH current will flow from input terminal means 22 through diode 128 via conductor means 38 to point 134 of conductor means 110, through resistance means 112 and into base 108 of transistor 96 causing transistor 96 to turn "on". The current at point 134 cannot flow to point 116 because of diode 114. As transistor 96 thusly becomes conductive through its collector 98 emitter 102 circuit, the circuit through sensory signal generating means 88 is completed and the means 88, thusly being energized, produces an audible alarm.

As previously stated, during normal conditions, the input signals from respective transducer means 166, 172 and 176 to input terminal means 14, 20 and 24 are each HIGH and, as explained, transistor 96 is "off" and alarm means 88 is de-energized. It should be mentioned that when transistor 96 is "off", resistance means 118 serves to, at that time, hold base 108 effectively at ground potential.

However, when such input signal to terminal means 14 becomes LOW, effectively equivalent to electrical ground, current will flow from conductor means 78, through resistance means 90 to conductor means 56 and through conductor means 30 and diode 50. As a consequence, the voltage drop produced by diode 50 is insufficient, as sensed at base 72 of transistor 64, to turn transistor 64 "on". Therefore, with transistor 64 being "off" (non-conducting through its collector-emitter circuit), resistance means 80 is placed, effectively, in series with resistance means 112, through diode 114, applying current flow to base 108 of transistor 96 thereby turning transistor 96 "on". As transistor 96 thusly becomes conductive through its collector-emitter circuit, the circuit through sensory signal generating means 88 is completed and the means 88, thusly being energized, produces an audible alarm.

Similarly, when such input signal to terminal means 20 becomes LOW, effectively equivalent to electrical ground, current will flow from conductor means 78, through resistance means 90 to conductor means 56 and through conductor means 36 and diode 52. As a consequence, the voltage drop produced by diode 52 is insufficient, as sensed at base 72 of transistor 64, to turn transistor 64 "on". Therefore, with transistor 64 being "off" (non-conducting through its collector-emitter circuit), resistance means 80 is placed, effectively, in series with resistance means 112, through diode 114, applying current flow to base 108 of transistor 96 thereby turning transistor 96 "on". As transistor 96 thusly becomes conductive through its collector-emitter circuit, the circuit through sensory signal generating means 88 is completed and the means 88, thusly being energized, produces an audible alarm.

Further, when such input signal to terminal means 24 becomes LOW, effectively equivalent to electrical ground, current will flow from conductor means 78, through resistance means 90 to conductor means 56 and through conductor means 40 and diode 54. As a consequence, the voltage drop produced by diode 54 is insufficient, as sensed at base 72 of transistor 64, to turn transistor 64 "on". Therefore, with transistor 64 being "off" (non-conductive through its collector-emitter circuit), resistance means 80 is placed, effectively, in series with resistance means 112, through diode 114, applying current flow to base 108 of transistor 96 thereby turning transistor 96 "on". As transistor 96 thusly becomes conductive through its collector-emitter circuit, the circuit through sensory signal generating means 88 is completed and the means 88, thusly being energized, produces an audible alarm.

In view of the foregoing, it can be seen that transistor means 96 and 64 each provide switching functions. That is, when transistor 96 is "on" the warning means 88 is activated and when 96 is "off" the means 88 is deactivated. Similarly, when the input signals on terminals 14, 20 and 24 are normal, transistor 64 is "on" thereby keeping transistor 96 "off" except that in such a condition if the inputs on terminals 16, 18 or 22 should become abnormal the transistor 96 is turned "on".

Diodes 50, 52 and 54 are provided in order to isolate respective related input terminal means 14, 20 and 24, as well as the input signals applied thereto, so that when either of the input terminal means 14, 20 or 24 is made LOW, effectively equivalent to electrical ground, such does not result in the grounding of any of the other terminal means.

Similarly, diodes 124, 126 and 128 are provided in order to isolate respective related input terminal means 16, 18 and 22, as well as the input signals applied thereto, so that when either of the input terminal means 16, 18 or 22 is made HIGH, such does not result in making any of the other terminal means HIGH.

In view of the foregoing, it can be seen that the electrical warning means and/or system 10 is capable of receiving any number of HIGH and LOW input signals from a like number of monitored functions and, in turn, producing a sensory output signal indicative of any of such input signals reflecting an abnormal or undesired condition of such monitored functions.

Further, in the embodiment of FIG. 8, an input signal, indicative of any abnormal or undesired condition of a monitored function, applied to either input terminal means 14 or 16 or 18 or 20 or 22 or 24 is effective for causing the production of a sensory output signal. In view of the foregoing, it should now be apparent that the various transducer means 166, 168, 170, 172, 174 and 176 may be switch means bringing the input terminal means 14, 16, 18, 20, 22 and 24 effectively to electrical ground potential or to some higher value depending upon the existing condition of the monitored parameter.

FIGS. 2, 3, 4, 5 and 6 illustrate modifications of the invention as disclosed in FIG. 1. In each of FIGS. 2, 3, 4, 5 and 6 only so much of the circuitry of FIG. 1 is shown as is necessary to understand the modification depicted and described. Further, all elements in FIGS. 2, 3, 4, 5 and 6 which are like or similar to those of FIG. 1 are identified with like reference numbers.

Figure 2:
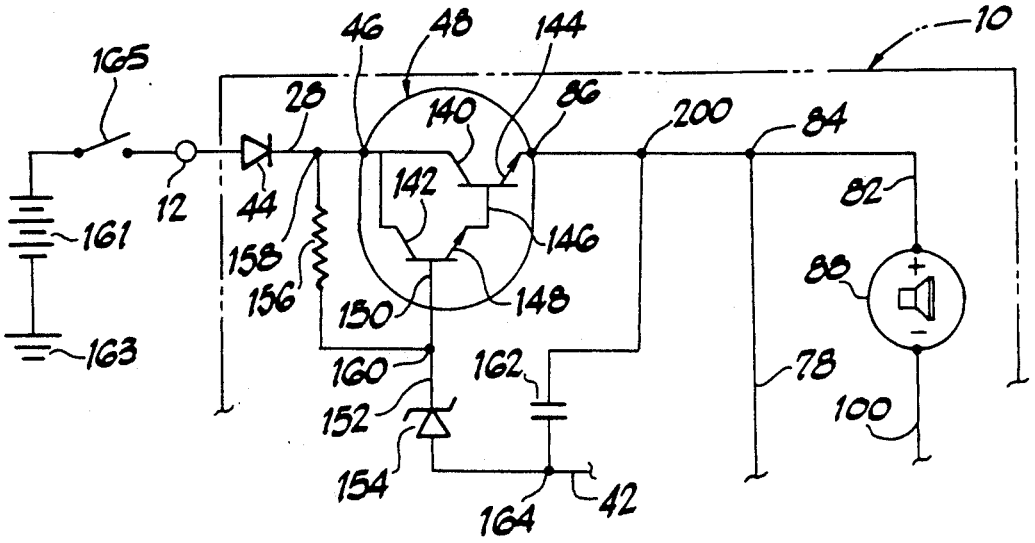
FIGS. 2, 3, 4, 5 and 6 are each fragmentary portions of the circuitry of FIG. 1 and respectively illustrating modifications of the electrical monitor of FIG. 1.

By comparing FIGS. 1 and 2, it can be seen that the modification contemplated in FIG. 2 resides in the manner or electrical placement of capacitor means 162. That is, even though one electrical side of capacitor means 162 is still brought to electrical ground, as at 164 in the manner shown in FIG. 1, the other electrical side of capacitor 162, in FIG. 2, is brought electrically to the emitter 144 of transistor 48 as depicted by point 200 of conductor means 82. By placing the capacitor means 162, as depicted in FIG. 2, the response time of the transistor 48, responding to any voltage spikes as at input terminal means 12, will be shortened.

Figure 3:
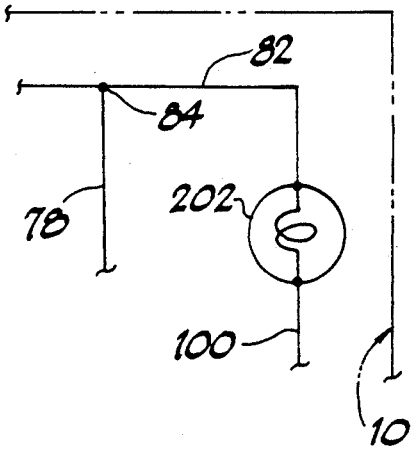

FIG. 3 illustrates that the sensory signal generating means may, in fact, be suitable lamp or light generating means 202 and that such may be substituted for the output signal generating means 88 of FIGS. 1 or 2.

Figure 4:
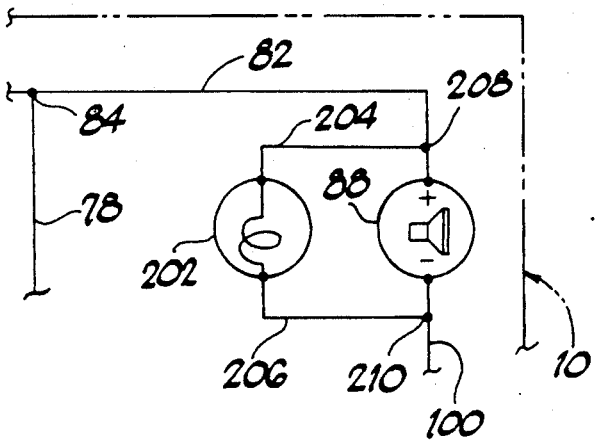

FIG. 4 illustrates that the apparatus 10 may be modified as to comprise the output signal generating means 88, of FIGS. 1 or 2, and the output signal generating means 202 of FIG. 3 with such, preferably, being in parallel to each other as by having the light generating means 202 electrically connected, as via conductor means 204, to conductor means 82 as at a point 208 thereof and, as via conductor means 206, to conductor means 100 as at a point 210 thereof.

Figure 5:
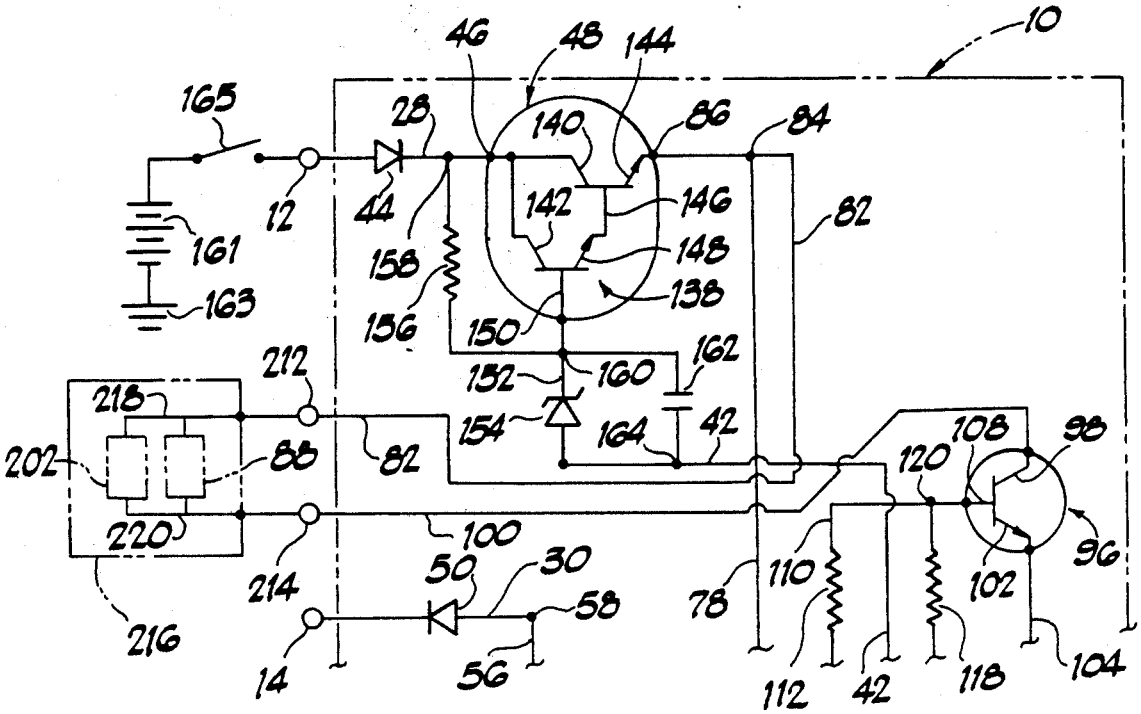

The modification of FIG. 5 contemplates having the apparatus 10 provided with additional terminal means 212 and 214 respectively electrically connected to conductor means 82 and 100. The output signal generating means 216 may be effectively separated from the remainder of apparatus 10 and, for example, fixedly mounted as on the instrument panel of the associated automotive (or other) vehicle or as on the instrument or control panel means of other associated apparatus, industrial or otherwise, the related parameters which are being monitored. For simplicity of illustration, the output signal generating means 216 is depicted diagrammatically, as comprising the signal generating means (of FIGS. 1, 2 and 4) and the signal generating means 202 FIGS. 3 and 4) electrically coupled to each other and to input terminal means 212 and 214 as by parallel conductor means 218 and 220.

Figure 6:
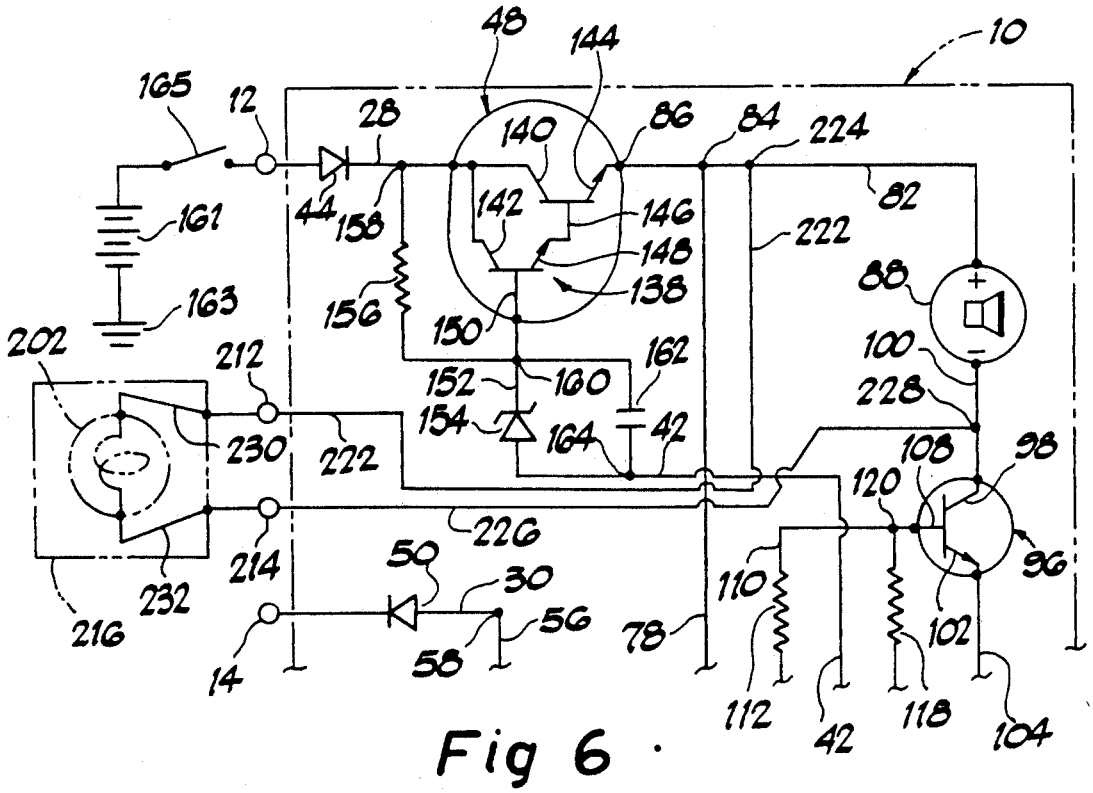

FIG. 6 is, in the main, similar to the embodiments of FIGS. 1 or 2 and FIG. 5. That is, one of the output signal generating means 88 is depicted as being within assembly or apparatus 10, in the manner disclosed in FIGS. 1 or 2, while a second output signal generating means 216 is depicted as being remotely situated with respect to assembly 10 as may occur by having the signal generating means 216 fixedly mounted on other apparatus as herein set forth and discussed with reference to FIG. 5. In the embodiment of FIG. 6, the additional input contact means 212 is electrically connected to conductor means 82, as at a point 224 thereof, as via conductor means 222 while additional input contact means 214 is electrically connected, as via conductor means 226, to conductor means 100 as at a point 228 thereof. In the embodiment of FIG. 6, the output auditory signal generating means 88 is depicted as being within the assembly 10 while the remotely situated output signal generating means 216 is illustrated as comprising the lamp or visual output signal generating means 202. Of course, in FIG. 6, the auditory output signal generating means 88 could be replaced by a lamp assembly or visual output signal generating means functionally equivalent to means 202 and, likewise, the visual output signal generating means 202 could be replaced by an auditory signal generating means functionally equivalent to means 88 thereby having either two spaced (one within the assembly 10 and the other remotely situated) visual signal generating means or two spaced auditory signal generating means.

In the preferred embodiment, the various elements, shown contained within the encompassing fanthom line identified by reference number 10, would be operatively carried by a printed circuit board as would the input terminal means; further the various conductors depicted in any of the Figures, as also generally within said fanthom line identified by reference number 10, would preferably be formed by functionally equivalent printed circuits carried by such printed circuit board.

Although only a preferred embodiment and a limited number of modifications thereof have been disclosed and described, it is apparent that other embodiments and modifications of the invention are possible within the scope of the appended claims.

What is claimed is:

1. A multi-input electrical monitor, comprising a plurality of input terminal means effective for connection to a plurality of associated condition sensing means, second terminal means for in circuit connection to an associated source of electrical potential, wherein at least a certain of said plurality of input terminal means receives a first input signal from a certain of said associated condition sensing means, wherein said first input signal is either electrically HIGH or electrically LOW depending upon the condition sensed said certain of said associated condition sensing means, wherein said first input signal is electrically HIGH when the condition sensed by said certain of said associated condition sensing means is normal, wherein said first input signal is electrically LOW when the condition sensed by said certain of said associated condition sensing means is abnormal, wherein at least an other of said plurality of input terminal means receives a second input signal from an other of said associated condition sensing means, wherein said second input signal is either electrically HIGH or electrically LOW depending upon the condition sensed by said other of said associated condition sensing means, wherein said second input signal is electrically LOW when the condition sensed by said other of said associated condition sensing means is normal, wherein said second input signal is electrically HIGH when the condition sensed by said other of said associated condition sensing means is abnormal, output signal generating means electrically connected to said second terminal means, and electrical logic circuitry means electrically interconnecting said certain of said plurality of input terminal means and said other of said plurality of input terminal means to said output signal generating means whereby said output signal generating means is caused to produce an output signal whenever said first input signal is electrically LOW or whenever said second input signal is electrically HIGH.

2. A multi-input electrical monitor according to claim 1 wherein said output signal generating means comprises sensory signal generating means.

3. A multi-input electrical monitor according to claim 2 wherein said sensory signal generating means comprises auditory signal generating means 4. A multi-input electrical monitor according to claim 2 wherein said sensory signal generating means comprises visual signal generating means.

5. A multi-input electrical monitor according to claim 2 wherein said sensory signal generating means comprises both auditory and visual signal generating means.

6. A multi-input electrical monitor according to claim 1 and further comprising third and fourth terminal wherein said third terminal means is electrically in series with said second terminal means, and wherein said output signal generating means is remotely situated and electrically connected to said third and fourth terminal means as to thereby be electrically connected to said second terminal means and complete an electrical circuit between said third and fourth terminal means.

7. A multi-input electrical monitor according to claim 6 wherein said output signal generating means comprises sensory signal generating means.

8. A multi-input electrical monitor according to claim 7 wherein said sensory signal generating means comprises auditory signal generating means.

9. A multi-input electrical monitor according to claim 7 wherein said sensory signal generating means comprises visual signal generating means.

10. A multi-input electrical monitor according to claim 7 wherein said sensory signal generating means comprises both auditory and visual signal generating means.

11. A multi-input electrical monitor according to claim 1 and further comprising voltage regulator means, said voltage regulator means being electrically in series with and between said second terminal means and said output signal generating means.

12. A multi-input electrical monitor according to claim 1 and further comprising diode means in series circuit with and between said second terminal means and said output signal generating means, said diode means being effective to prevent damage resulting from a reverse polarity connection of said second terminal means to said associated source of electrical potential.

13. A multi-input electrical monitor according to claim 1 and further comprising voltage regulator means, said voltage regulator means being electrically in series with a between said second terminal means and said output sign generating means, and diode means, said diode means being in series circuit with and between said second terminal means and said voltage regulator means, said diode means being effective to prevent damage resulting from a reverse polarity connection of said second terminal means to said associated source of electrical potential.

14. A multi-input electrical monitor according to claim 1 and further comprising voltage regulator means, said voltage regulator means comprising Darlington transistor means having collector emitter and base terminals, wherein said collector and emitter terminals are electrically in series with and between said second terminal means and said output signal generating means, electrical resistance means electrically connected from said collector terminal to said base terminal, zener diode means electrically connected from said base terminal to a reference voltage potential, and capacitor means, said capacitor means having one electrical side connected to said base terminal and an other electrical side connected to said reference voltage potential.

15. A multi-input electrical monitor according to claim 1 and further comprising voltage regulator means, said voltage regulator means comprising Darlington transistor means having collector emitter and base terminals, wherein said collector and emitter terminals are electrically in series with and between said second terminal means and said output signal generating means, electrical resistance means electrically connected from said collector terminal to said base terminal, zener diode means electrically connected from said base terminal to a reference voltage potential, and capacitor means, said capacitor means having one electrical side connected to said emitter terminal and an other electrical side connected to said reference voltage potential.

16. A multi-input electrical monitor according to claim 1 wherein said output signal generating means comprises first and second output signal generating means, wherein said second output signal generating means is remotely situated with respect to said first output signal generating means and carried as by structure associated with said condition sensing means, and further comprising third and fourth terminal means, wherein said third terminal means is electrically in series with said second terminal means, and wherein said second output signal generating means is electrically connected to said third and fourth terminal means as to thereby be electrically electrical circuit between said third and fourth terminal means.

17. A multi-input electrical monitor according to claim 16 wherein one of said first and second output signal generating means comprises auditory signal generating means, and wherein the other of said first and second output signal generating means comprises visual signal generating means.

18. A multi-input electrical monitor according to claim 1 wherein said electrical logic circuitry means comprises first and second electrical switch means each having "on" and "off" states, said first electrical switch means being electrically connected to said output signal generating means as to thereby place said output signal generating means electrically between said first electrical switch means and said second terminal means, wherein said second electrical switch means is electrically connected to said second terminal means, wherein said second electrical switch means is electrically connected to said first switch means so that when said second switch means is in its "on" state said first switch means is in its "off" state, wherein said certain of said plurality of input terminal means is electrically connected to said second switch means, wherein when said first input signal on said certain of said plurality of input terminal means is electrically HIGH said second switch means is caused to be in its "on" state and said first switch means is caused to be in its "off" state, wherein when said first input signal on said certain of said plurality of input terminal means is electrically LOW said second switch means is caused to be in its "off" state and said first switch means is caused to be in its "on" state thereby causing energization of said output signal generating means, wherein said other of said plurality of input terminal means is electrically connected to said first switch means, wherein when said second input signal on said other of said plurality of input terminal means is electrically LOW and said second switch means is in its "on" state said first switch means remains in its "off" state, and wherein when said second input signal on said other of said plurality input terminal means is electrically HIGH said first switch means is caused to be in its "on" state even though said second switch means is in its "on" state.

19. A multi-input electrical monitor according to claim 18 wherein said certain of said plurality of input terminal means comprises a plurality of certain input terminal means, wherein each of said plurality of certain input terminal means receives respective input signals from associated ones said plurality of condition sensing means, wherein each of said plurality of certain input terminal means is electrically connected to said second switch means, and wherein said second switch means is caused to be in its "on" state whenever any of the respective input signals from said associated ones of said plurality of condition sensing means and applied to said plurality of certain input terminal means is electrically HIGH.

20. A multi-input electrical monitor according to claim 18 wherein said other of said plurality of input terminal means comprises a plurality of other input terminal means, wherein each of said plurality of other input terminal means is electrically connected to said first switch means, wherein each of said plurality of other input terminal means receives respective input signals from other ones of said plurality of condition sensing means, and wherein said first switch means is caused to be in its "on" state whenever any of the respective input signals from said other ones of said plurality of condition sensing means and applied to said plurality of other input terminal means is electrically HIGH.

21. A multi-input electrical monitor according to claim 18 wherein said certain of said plurality of input terminal means comprises a plurality of certain input terminal means, wherein each of said plurality of certain input terminal means receives respective input signals from associated ones of said plurality of condition sensing means, wherein each of said plurality of certain input terminal means is electrically connected to said second switch means, wherein said second switch means is caused to be in its "on" state whenever any the respective input signals from said associated ones of said plurality of condition sensing means and applied to said plurality of certain input terminal means is electrically HIGH, wherein said other of said plurality of input terminal means comprises a plurality of other input terminal means, wherein each of said plurality of other input terminal means is electrically connected to said first switch means, wherein each of said plurality of other input terminal means receives respective input signals from other ones of said plurality condition sensing means, and wherein said first switch means caused to be in its "on" state whenever any of the respective input signals from said other ones of said plurality of condition sensing means and applied to said plurality of other input terminal means is electrically HIGH.

22. A multi-input electrical monitor according to claim 18 wherein both said first electrical switch means and said second electrical switch means comprise solid state switching devices.

23. A multi-input electrical monitor according to claim 18 wherein said first electrical switch means comprises first transistor means having an emitter collector and base, wherein said second electrical switch means comprises second transistor means having an emitter collector and base, wherein the collector and emitter of said first transistor means are in series circuit with said output signal generating means, wherein said second transistor means is electrically connected to said second terminal means through the collector and emitter of said second transistor means, wherein the collector emitter of said second transistor means is electrically connected to said base of said first transistor means, wherein said base of said first transistor means is electrically connected to said other of said plurality of input terminal means, and wherein said base of said second transistor means is electrically connected to said certain of said plurality of input terminal means.

24. A multi-input electrical monitor according to claim 23 wherein said certain of said plurality of input terminal means comprises a plurality of certain input terminal means, and wherein said base of said second transistor means is electrically connected to said plurality of certain input terminal means.

25. A multi-input electrical monitor according to claim 24 and further comprising diode means respectively in circuit between said base of said second transistor means and each of said plurality of certain input terminal means.

26. A multi-input electrical monitor according to claim 23 wherein said other of said plurality of input terminal means comprises a plurality of other input terminal means, and wherein said base of said first transistor means is electrically connected to said plurality of other input terminal means.

27. A multi-input electrical monitor according to claim 26 and further comprising diode means respectively in circuit between said base of said first transistor means and each of said plurality of other input terminal means.

28. A multi-input electrical monitor according to claim 23 wherein said certain of said plurality of input terminal means comprises a plurality of certain input terminal means, wherein said base of said second transistor means is electrically connected to said plurality of certain input terminal means, wherein said other of said plurality of input terminal means comprises a plurality of other input terminal means, and wherein said base of said first transistor means is electrically connected to said plurality of other input terminal means.

29. A multi-input electricial monitor according to claim 28 and further comprising first diode means respectively in circuit between said base of said first transistor means and each of said plurality of other input terminal means, and second diode means respectively in circuit between said base of said second transistor means and each of said plurality of certain input terminal means.

30. A multi-input electricial monitor according to claim 28 and further comprising first diode means respectively in circuit between said base of said first transistor means and each of said plurality of other input terminal means, second diode means respectively in circuit between said base of said second transistor means and each of said plurality of certain input terminal means, third diode means, and wherein said collector emitter of said second transistor means is electrically connected to said base of said first transistor means through said third diode means.

* * * * *

UNITED STATES PATENT AND TRADEMARK OFFICE

CERTIFICATE OF CORRECTION

PATENT NO. : 5,043,701

DATED : August 27, 1991

INVENTOR(S) : Michael J. Rymut

It is certified that error appears in the above-identified patent and that said Letters Patent is hereby corrected as shown below:

Column 2, line 36, change "o" to --- of ---.

Column 3, line 31, after "point" change "60" to --- 160 ---.

Column 4, line 7, between "trailer" and "correctness" insert --- (j) ---.

Column 4, line 42, change "volta" to --- voltage ---.

Column 5, line 39, between "input" and "voltage" insert --- terminal means 22. Further, let it be assumed that such ---.

Column 5, line 55, change "volt" to --- voltage ---.

Column 6, line 18, before "voltage" insert --- The ---.

Column 6, line 32, between "in" and "referred" insert --- parallel with the 12.0 volt battery of the vehicle (sometimes ---.

Column 6, line 49, between "72" and "transistor" insert --- of ---.

UNITED STATES PATENT AND TRADEMARK OFFICE

CERTIFICATE OF CORRECTION

PATENT NO. : 5,043,701

DATED : August 27, 1991

INVENTOR(S) : Michael J. Rymut

It is certified that error appears in the above-identified patent and that said Letters Patent is hereby corrected as shown below:

Column 8, line 54, change "Fig. 8" to --- Fig. 1 ---.

Column 9, line 41, after "generating means" insert --- 88 ---.

Column 9, line 43, before "Figs. 3 and 4)" insert --- (of ---.

Column 10, line 32 After "sensed" insert --by--.

Column 11, line 41 (Claim 13, line 4 thereof), after "with" change "a" to --- and ---.

Column 11, line 42 (Claim 13, line 5 thereof), change "sign" to --- signal ---.

Column 12, line 21 (Claim 16, line 13 thereof), between "electrically" and "electrical" insert --- connected to said second terminal means and complete an ---.

UNITED STATES PATENT AND TRADEMARK OFFICE

CERTIFICATE OF CORRECTION

PATENT NO. : 5,043,701

DATED : August 27, 1991

INVENTOR(S) : Michael J. Rymut

It is certified that error appears in the above-identified patent and that said Letters Patent is hereby corrected as shown below:

Column 13, line 2 (Claim 19, line 6 thereof), after "ones" insert --- of ---.

Column 13, line 34 (Claim 21, line 9 thereof), after "any" insert --- of ---.

Column 13, line 44 (Claim 21, line 20 thereof), after "plurality" insert --- of ---.

Column 13, line 45 (Claim 21, line 21 thereof), after "switch means" insert --- is ---.

Signed and Sealed this

Sixteenth Day of March, 1993

*Attest:*

STEPHEN G. KUNIN

*Attesting Officer*

*Acting Commissioner of Patents and Trademarks*